US005865450A

United States Patent [19]

Ulrich

[11] Patent Number: 5,865,450

[45] Date of Patent: Feb. 2, 1999

[54] BABY WALKER SAFETY DEVICE

[76] Inventor: Alan A. Ulrich, 9900 Greenhaven Pkwy., Brecksville, Ohio 44141

[21] Appl. No.: 550,533

[22] Filed: Oct. 30, 1995

[51] Int. Cl.[6] ..... B62B 3/00

[52] U.S. Cl. ..... 280/87.051; 280/47.34

[58] Field of Search ..... 280/87.051, 47.35, 280/33.994, 87.041; 188/5, 6, 7

[56] References Cited

U.S. PATENT DOCUMENTS

| | | | |
|---|---|---|---|
| 5,366,231 | 11/1994 | Hung | 280/87.051 |
| 5,371,922 | 12/1994 | Cherm et al. | 16/47 |
| 5,564,724 | 10/1996 | Huang | 280/87.051 |

*Primary Examiner*—Richard M. Camby
*Attorney, Agent, or Firm*—Emerson & Assoc.; Roger D. Emerson; Mark E. Duell

[57] ABSTRACT

A baby walker including a frame, a seat for supporting an associated baby thereon, main wheels rotatably affixed to the frame for enabling translating of the baby walker across flat surfaces, a support arm having an upper end and a lower end, the upper end being swingably attached to the frame, and a stopper attached to the lower end of the support arm, and an extension having a first end and second end, the first end being swingably attached to the frame, and an interface for interfacing with an associated floor fixed to the second end of the extension. The stopper selectively engages and immobilizes the main wheels when actuated by actuating means. The baby walker also has a safety alarm including a buzzer connected to the frame, a battery connected to the buzzer, a first contact attached to the frame, a first wire connecting the first contact and the buzzer, a second contact attached to the plate steel support, a second wire connecting the second contact and the buzzer, the first contact and the second contact being separated when the safety wheel and the main wheel have equal elevation, and the first contact and the second contact coming together causing the buzzer to operate when the safety wheel drops to lower vertical elevation than the main wheel.

13 Claims, 14 Drawing Sheets

BABY WALKER SAFETY DEVICE

BACKGROUND OF THE INVENTION

1. Field of Invention

This invention pertains generally to the art of apparatuses to assist human infants to learn to walk upright, and more particularly to safety devices used with baby walkers to prevent the baby walker from falling down stairs or down inclines.

2. Description of the Related Art

Baby walkers are devices that allow babies that are not yet able to walk to move about in an upright position using their legs. The baby sits in a seat that has holes for the legs of the baby. The seat is mounted onto a frame with wheels. The baby can move the walker by moving its legs along the floor. The baby, supported by the seat and wheels of the frame, is able to move about without having to balance.

Baby walkers have consisted of a seat to support the baby, a frame, and wheels to help babies move around as if they were walking. Typically, there were no safety features to prevent a baby from walking the walker down a flight of stairs or down an inclined plane or to alert parents of a potentially dangerous situation.

As such, a need has arisen to provide a safety device to prevent a baby from walking a baby walker down stairs or an inclined plane. In addition, applicant recognized the need for a warning alarm to alert parents to the danger of a baby in a baby walker perilously close to a flight of stairs.

One particular known type of safety device for use with baby walkers contemplates the use of dual wheel unit that always faces toward the direction of motion. When the walker is walked to a ledge, the main wheel will be suspended over the edge, and an auxiliary wheel is prevented from moving in the direction of the ledge by a lock plate. The device does not activate until the main wheel of the baby walker is already over the edge. Also, the wheels, being made of a hard material, may still slide along a smooth floor surface, thus rendering the braking system ineffectual. Finally, the device may prove difficult for the baby to get the suspended main wheel back from over the edge.

The present invention contemplates a new and improved baby walker safety device which is simple in design, effective in use, and overcomes the foregoing difficulties and others while providing better and more advantageous overall results.

SUMMARY OF THE INVENTION

In accordance with the present invention, a new and improved baby walker safety device which prevents the baby walker from rolling over a ledge such as a stair or down an incline, and which can include an electronic safety alarm.

More particularly, in accordance with the present invention, a baby walker includes a frame, seating means for supporting a baby thereon, the seating means being supported on the frame, translation means for enabling translating of the baby walker across flat surfaces, the translation means being rotatably fixed to the frame, brake means for stopping the translation of the baby walker, and actuating means for activating the brake means.

According to another aspect of the present invention, a baby walker has an electronic safety alarm including a buzzer connected to the frame, a battery connected to the buzzer, translation means for allowing movement of the baby walker, the translation means being fixed to the frame and each including a main wheel directly fixed to the frame, a hinge attached to the frame, a plate steel support attached to the hinge and extending outward from the frame, and a safety wheel attached to the plate steel support. The electronic safety alarm further includes a first contact attached to the frame, a first wire connecting the first contact and the buzzer, a second contact attached to the plate steel support, a second wire connecting the second contact and the buzzer, the first contact and the second contact being separated when the safety wheel and the main wheel have equal elevation, and the first contact and the second contact coming together causing the buzzer to operate when the safety wheel drops to lower vertical elevation than the main wheel.

According to a further aspect of the invention, a method of stopping a baby walker when a wheel of the baby walker has gone over a ledge or down an inclined plane, the baby walker including an extension, interface means, a support arm, a stopper, and main wheels, the method includes the steps of lowering the extension when the interface means is lowered, lowering the support arm, engaging the stopper with a floor, and stopping the main wheels.

One advantage of the present invention is the capability to prevent a baby walker from going over a ledge.

Another advantage of the present invention is the capability to prevent the main wheels of a baby walker from going over a ledge.

Another advantage of the present invention is the capability to use high-friction rubber brake stoppers to stop the baby walker on hard surfaces or carpet when the brake is engaged.

Another advantage of the present invention is the capability to use high-friction rubber brake stoppers to stop the baby walker frame when the brake is engaged.

Another advantage of the present invention is to provide a safety buzzer to warn parents that a baby walker has been rolled to a place of peril by a baby and that the brake has been engaged.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangement of parts. A preferred embodiment of these parts will be described in detail in the specification and illustrated in the accompanying drawings, which form a part of this disclosure and wherein.

DESCRIPTION OF THE PREFERRED EMBODIMENT

Figure 1:
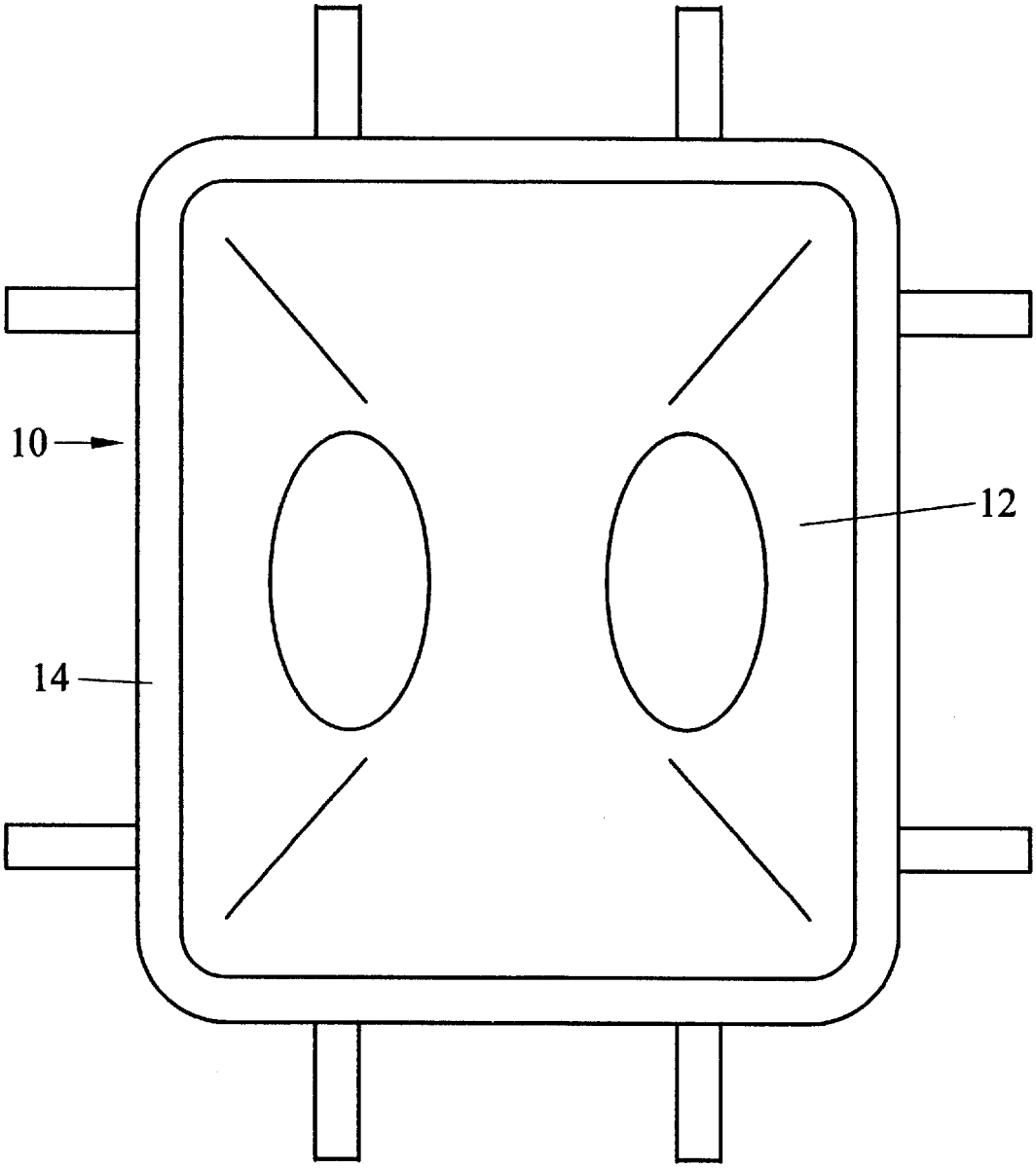
FIG. 1 is a top view of a baby walker.

Referring now to the drawings, which are for purposes of illustrating a preferred embodiment of the invention only, and not for purposes of limiting the invention, FIG. 1 shows a top view of a baby walker 10, with seat 12, a frame 14, and wheel units 16.

Figure 2:
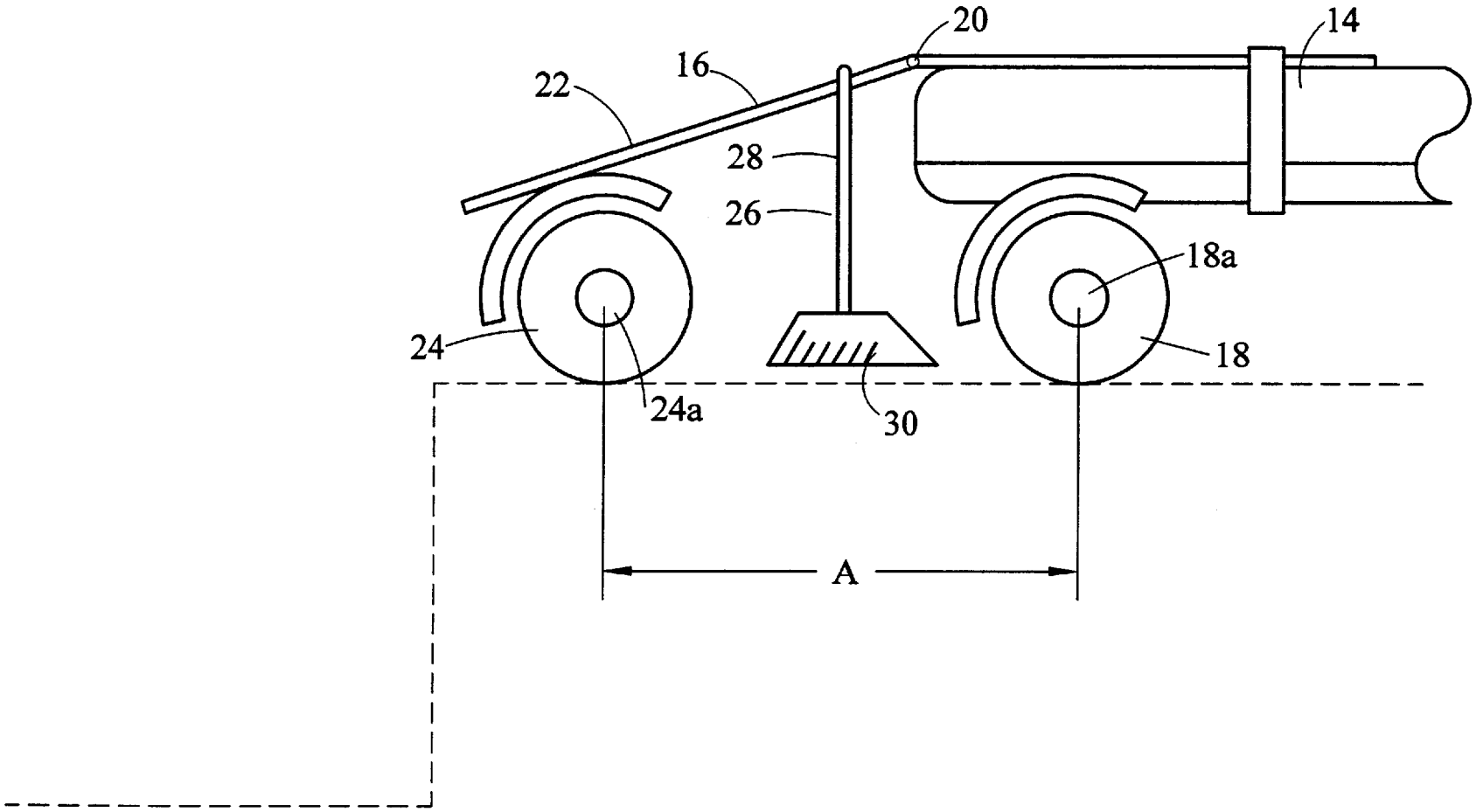
FIG. 2 is a side view of a wheel unit on a level surface.

FIG. 2 shows a detailed side view of a preferred embodiment of the wheel units 16 on a flat surface. The main wheel 18 is the primary wheel that supports the weight of the baby in the baby walker 10. The main wheel 18 is attached directly to the frame 14. A hinge 20 is connected to the frame 14 above the main wheel 18. A plate steel support 22 is connected to the hinge 20, and extends outward from the frame 14. A safety wheel 24 is attached to the end of the plate steel support 22 that is opposite of the hinge 20. A brake 26, which includes a support 28 and a stopper 30, is attached to the plate steel support 22 between the hinge 20 and the safety wheel 24. The support 22 is attached to the plate steel support 22, and hangs down toward the ground. The stopper 30 is attached at the bottom of the support 28.

In FIG. 2, the main wheel 18 and the safety wheel 24 are both on the same plane. The safety wheel 24 prevents the stopper 30 from touching the ground. The specific dimensions of the wheels are subject to variation depending on the dimensions of the baby walker 10. In the preferred embodiment, the horizontal distance A between the center of the main wheel 18*a* and the center of the safety wheel 24*a* is approximately 4.00 inches when the wheels 18, 24 are level.

Figure 3:
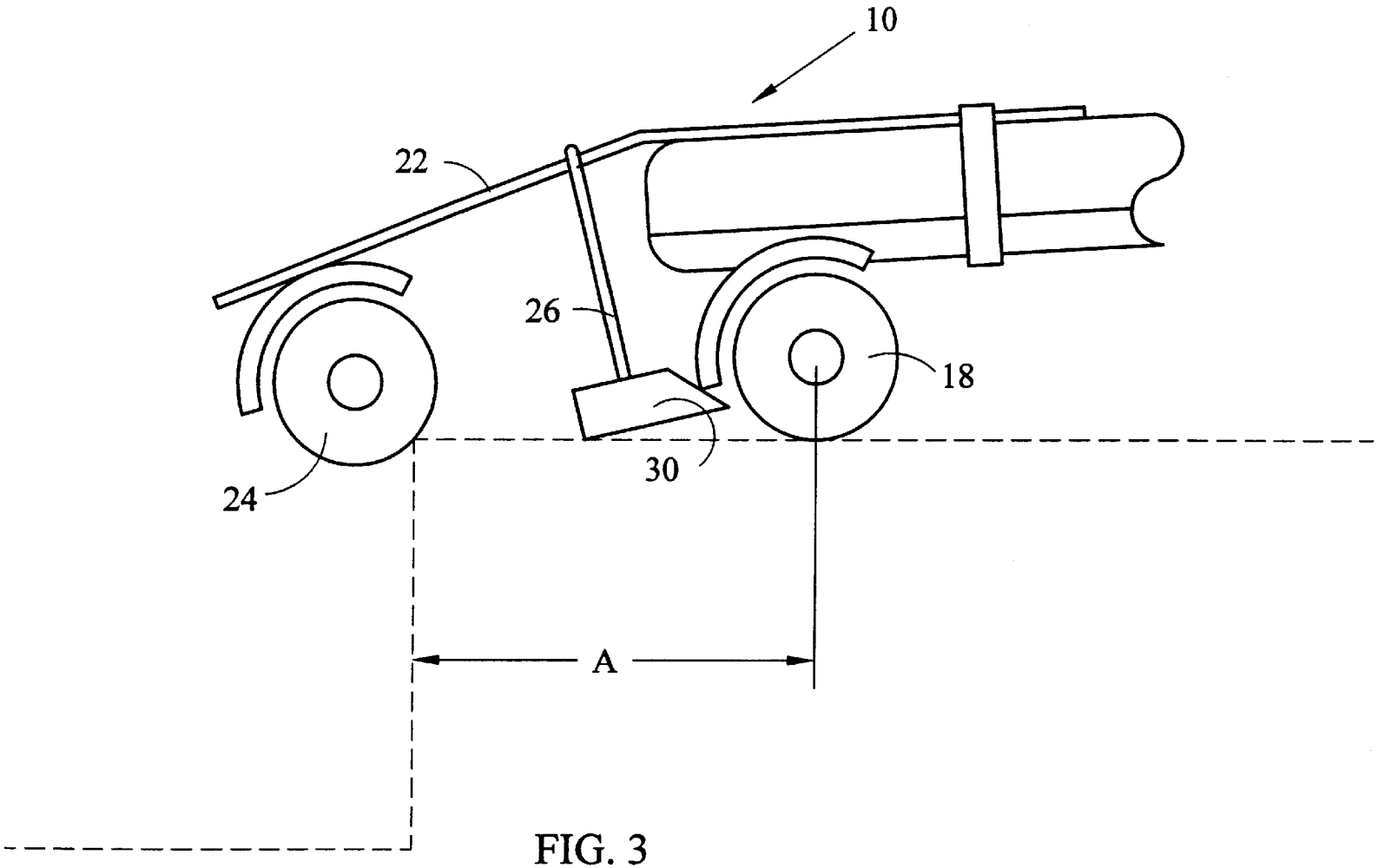
FIG. 3 is a side view of a wheel unit when the safety wheel first goes over a ledge.

FIG. 3 shows a situation when the baby walker 10 is going over a ledge. The safety wheel 24 is the first part of the baby walker 10 to go over the ledge. The safety wheel 24 lowers the plate steel support 22 as the safety wheel 24 proceeds over the ledge. The lowering of the plate steel support 22 in turn lowers the brake 26, causing the stopper 30 to come into contact with the floor. The stopper 30 is preferably composed of a high-friction, elastomeric material that will stop the baby walker 10 when the baby is unable to produce enough force to overcome the resistive force of friction between the stopper 30 and the floor. Additionally, the stopper 30 will act as a wedge between the main wheel 18 and the floor, stopping the baby walker 10. At this point, the horizontal distance A between the centers of the wheels 18*a* and 24*a* is approximately 2.94 inches.

Figure 4:
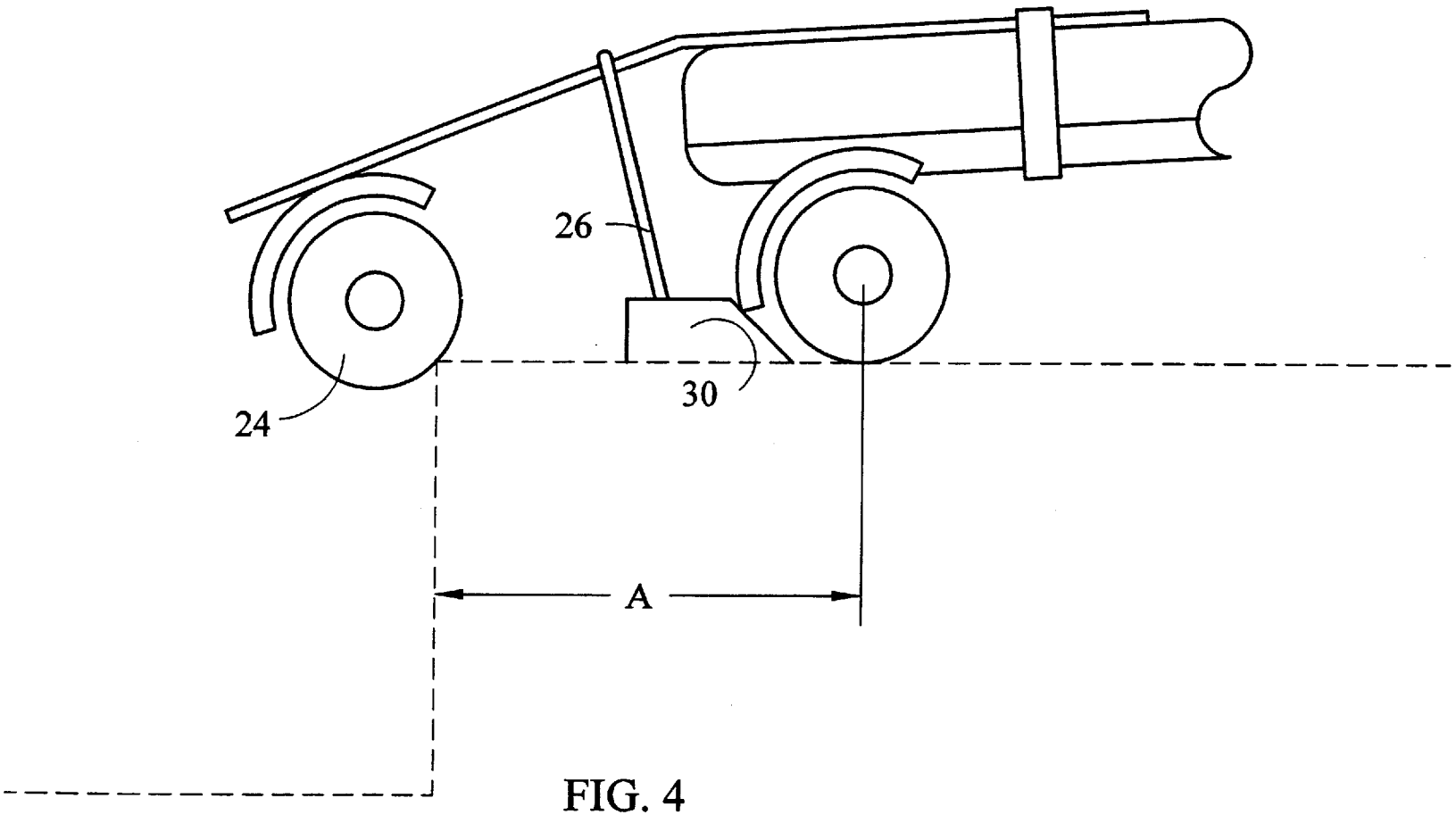
FIG. 4 is a side view of a wheel unit when the brake is fully engaged.

FIG. 4 shows another view with the safety wheel 24 over a ledge. The brake 26 is in full engagement with the stopper 30 squarely placed on the floor, a placement that provides maximum stopping force due to friction. The horizontal distance A between the two wheels 18 and 24 is approximately 2.88 inches at the time of full engagement.

Figure 5:
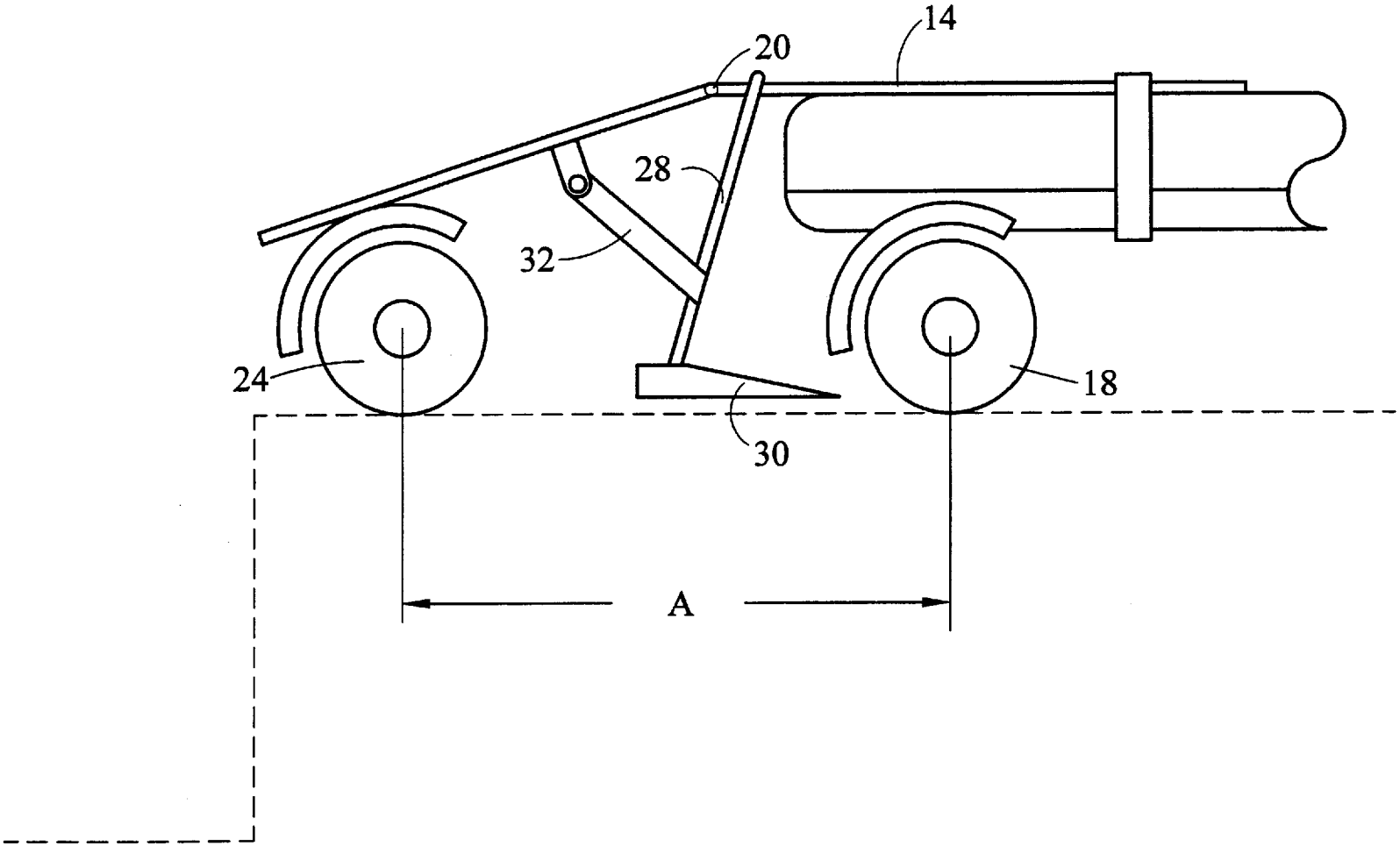
FIG. 5 is a side view of a wheel unit with a second preferred embodiment of the invention on a level surface.

FIG. 5 shows another preferred embodiment of the present invention. A second support 32 is attached to the brake 26 to offer greater stability. Both the support 28 and the second support 32 are fixed to the plate steel support 22 in a manner that allows them to swing freely in the direction of the safety wheel 24. In the embodiment illustrated, the support 28 is attached between the frame 14 and the hinge 20. Additionally, the stopper 30 is better shaped to act as a wedge, using a greater portion of a high-friction surface to stop the main wheel 18. In the embodiment illustrated in FIG. 5, the horizontal distance between the wheels A is approximately 4.00 inches. The support 28 may be attached to either the plate steel support 22 or the frame 14.

Figure 6:
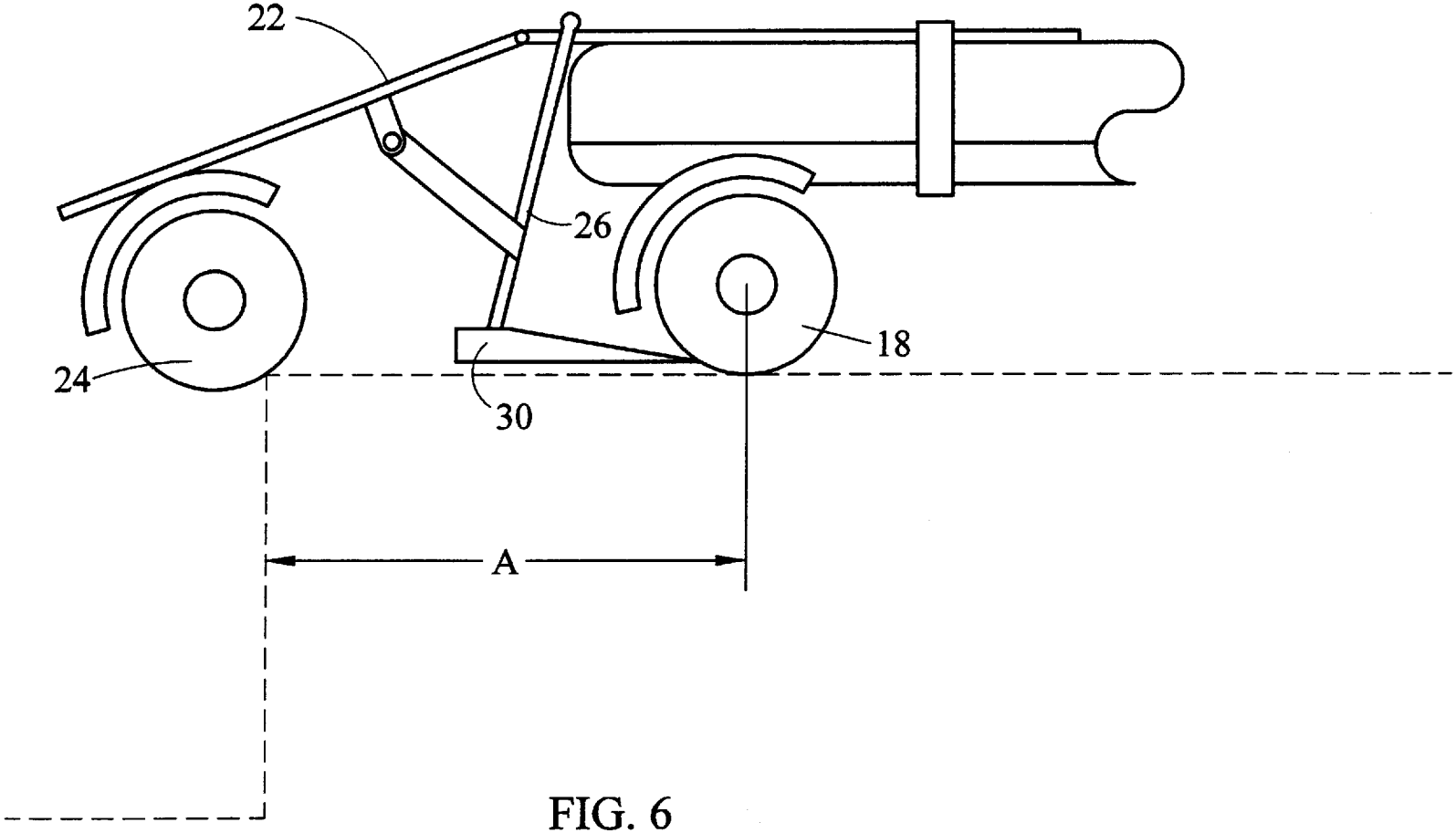
FIG. 6 is a side view of a wheel unit with a second preferred embodiment of the invention when the safety wheel first goes over a ledge.

FIG. 6 shows the initial engagement of the brake 26 in the second preferred embodiment. As before, the safety wheel 24 lowers the plate steel support 22 when the safety wheel 24 goes over the ledge. The plate steel support 22 lowers the brake 26, allowing the stopper 30 to come into contact with the main wheel 18. The stopper 30 acts as a wedge to stop the movement of the main wheel 18 in the direction of motion towards the ledge. In this embodiment of the invention, the horizontal distance between the wheels A is approximately 3.50 inches at initial contact.

Figure 7:
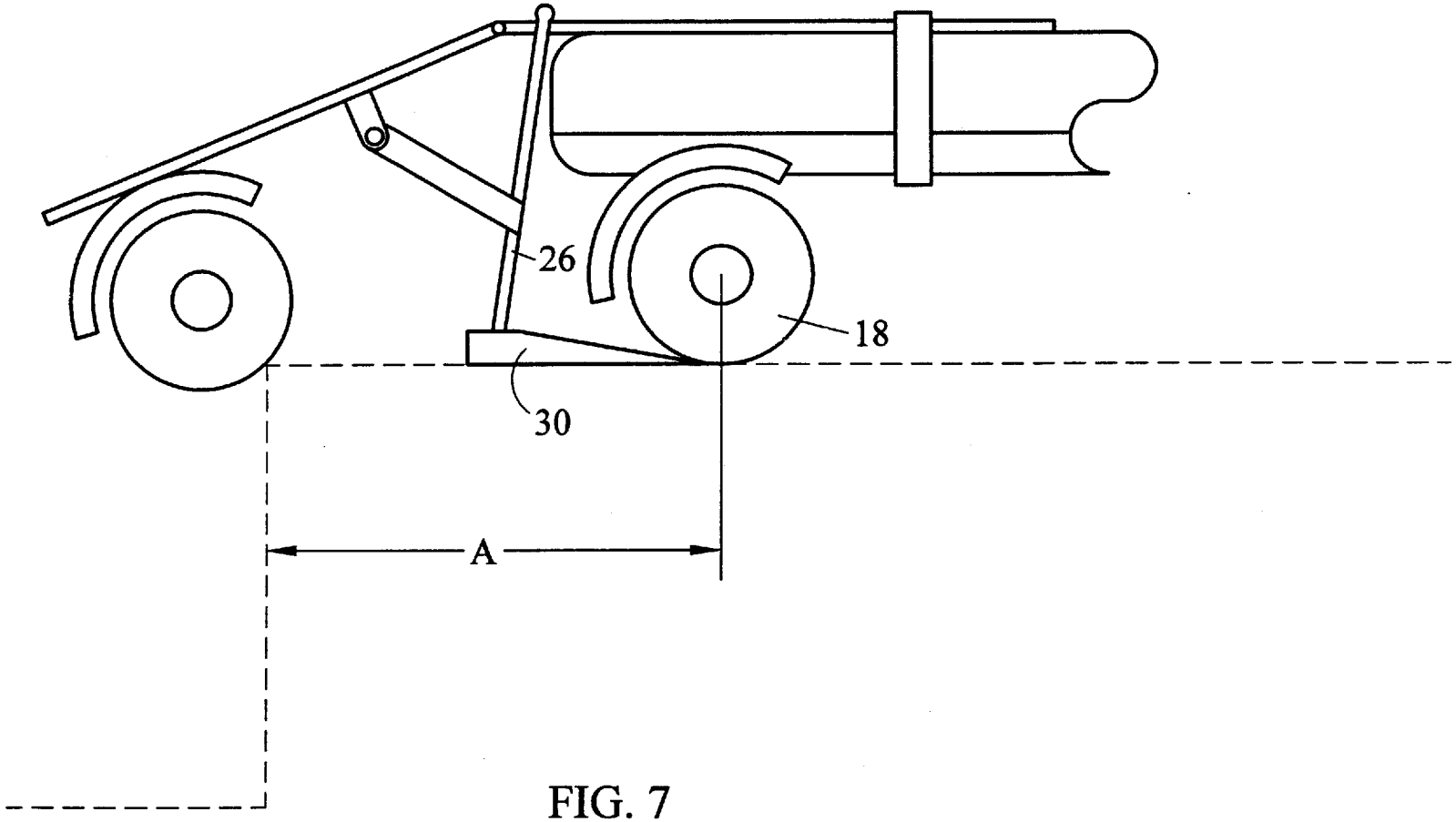
FIG. 7 is a side view of a wheel unit with a second preferred embodiment of the invention when the brake is fully engaged.

FIG. 7 shows the second embodiment of the invention at full stop with complete engagement of the brake 26. The stopper 30 is in full contact with the ground, and the wedge portion is completely engaged to stop the main wheel 18. The horizontal distance between the wheels A is approximately 3.00 inches at complete engagement.

Figure 8:
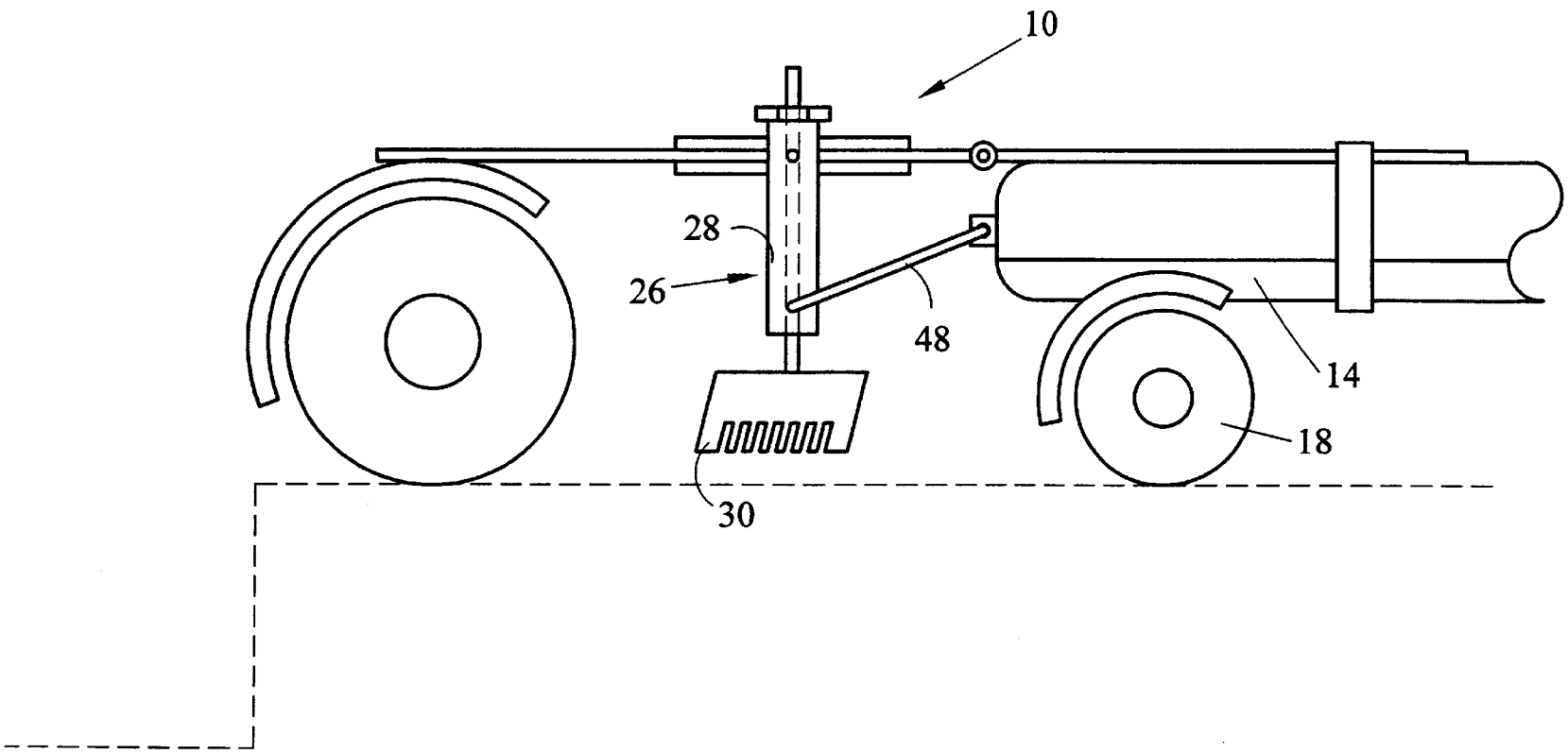
FIG. 8 is a side view of a wheel unit with a third preferred embodiment of the invention.

FIG. 8 shows a third preferred embodiment of the present invention. The stopper 30 is designed to stop the baby walker 10 using the friction force between the stopper 30 and the floor when the brake 26 is engaged. The stopper 30 does not come into contact with the first wheel 18 as with the previous embodiments. A stabilizer bar 48 is connected between the frame 14 and the support 28 to further stabilize the brake 26.

Figure 9:
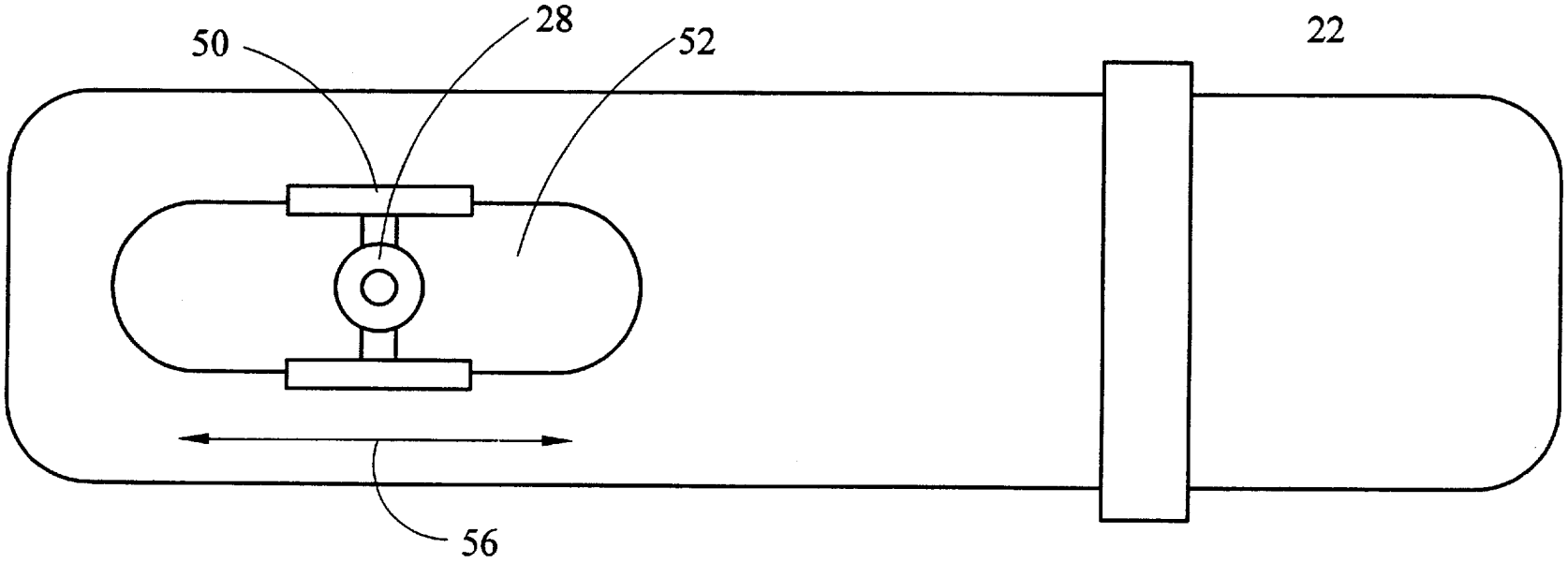
FIG. 9 is a top view of a plate steel support with a third preferred embodiment of the invention.

FIG. 9 shows a top view of the plate steel support 22 of the third preferred embodiment. The support 28 is connected to the plate steel support 22 by a bracket 50. The bracket 50 and support 28 are free to slide in a direction signified by arrow 56 within a slot 52 in the plate steel support 22 as the second wheel (not shown) moves in a vertical plane.

Figure 10:
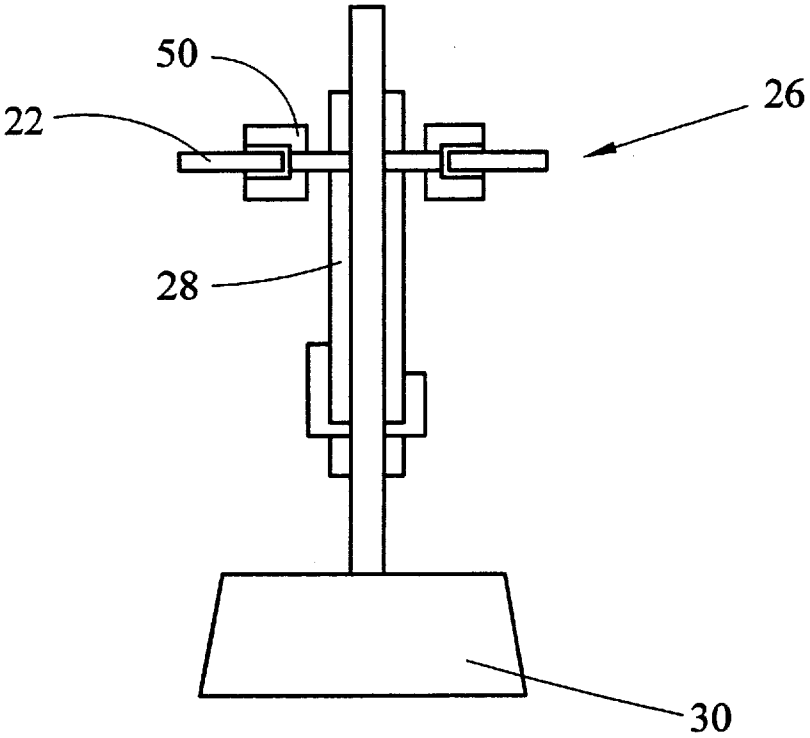
FIG. 10 is a cross-section frontal view of a brake.

FIG. 10 shows a front view of a cross-section of the brake 26. The support 28 is inserted into the stopper 30, and the stopper 30 and support 28 remain connected through the friction force between the support 28 and the stopper 30. Additionally, the support 28 may be covered with an adhesive to further strengthen the connection with the stopper 30. The stopper 30 may also be molded to the support 28 by rubber to metal bonding. The support 28 is further attached to a bracket 50 that connects the support 28 to the plate steel support 22.

Figure 11:
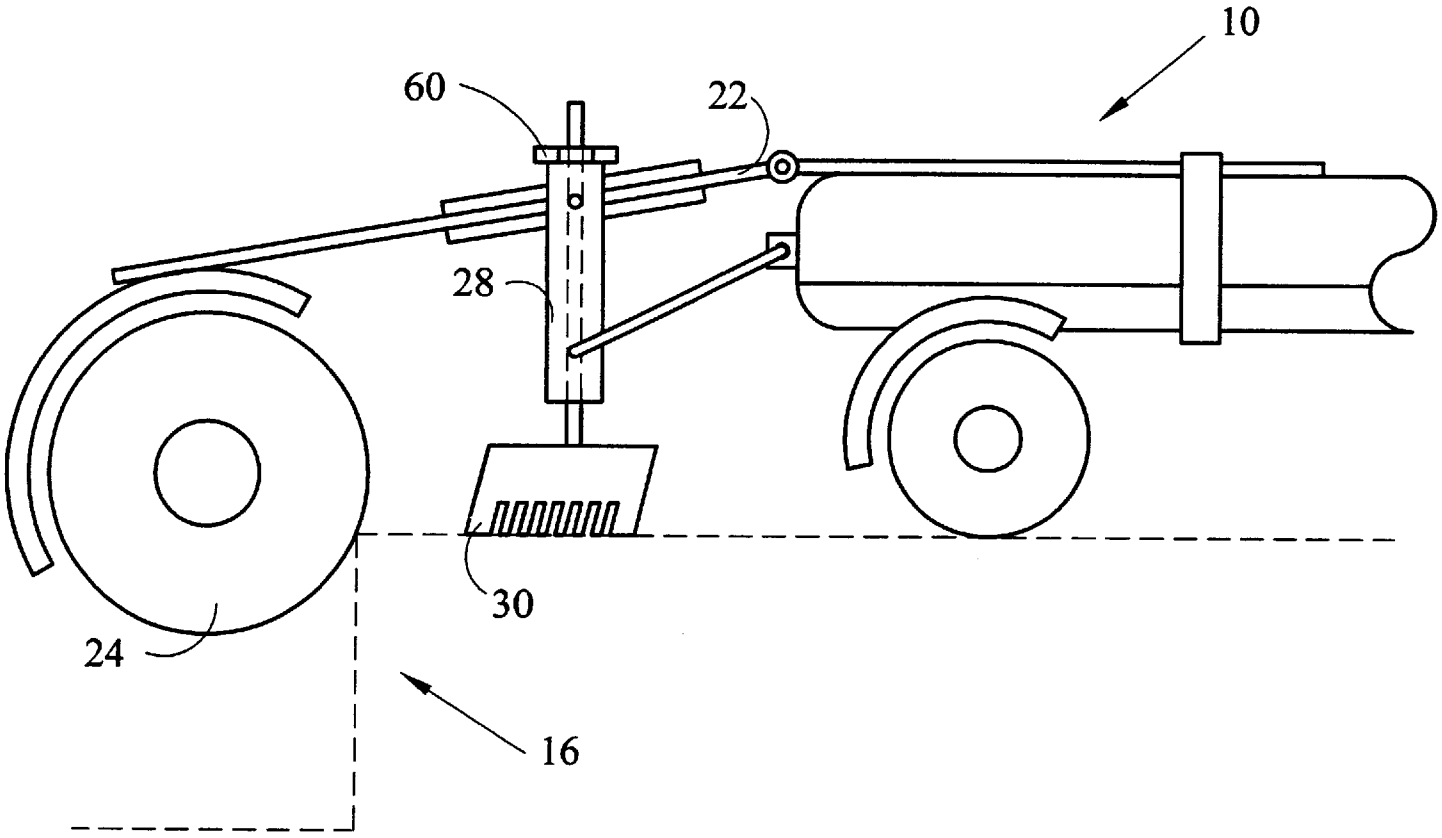
FIG. 11 is a side view of a wheel unit with a third preferred embodiment of the invention when the brake is fully engaged.

FIG. 11 shows the engagement of the brake 26 with the floor in the third preferred embodiment of the invention. When the second wheel 24 goes over the edge, the second wheel 24 lowers the plate steel support 22. The plate steel support 22 in turn lowers the support 28 and stopper 30, forcing the stopper 30 to come into contact with the ground and stopping the baby walker 10. The support 28 of the preferred embodiment of the invention has an adjustable nut 60 that may raise or lower the clearance of the support 28 and stopper 30 when turned. The adjustable nut 60 may be turned to adjust for a proper clearance for the stopper 30 based on the height of the main wheel 18 and the safety wheel 24 and the type of floor.

Additionally, in a preferred embodiment of the invention, two wheel units 16 are connected to each side of the baby walker 10. Two wheel units 16 per side provide a better safety feature than one wheel unit 16 per side. The baby walker 10 has four sides, front, back, left, and right so the baby walker preferably has a total of eight wheel units 16.

Figure 12:
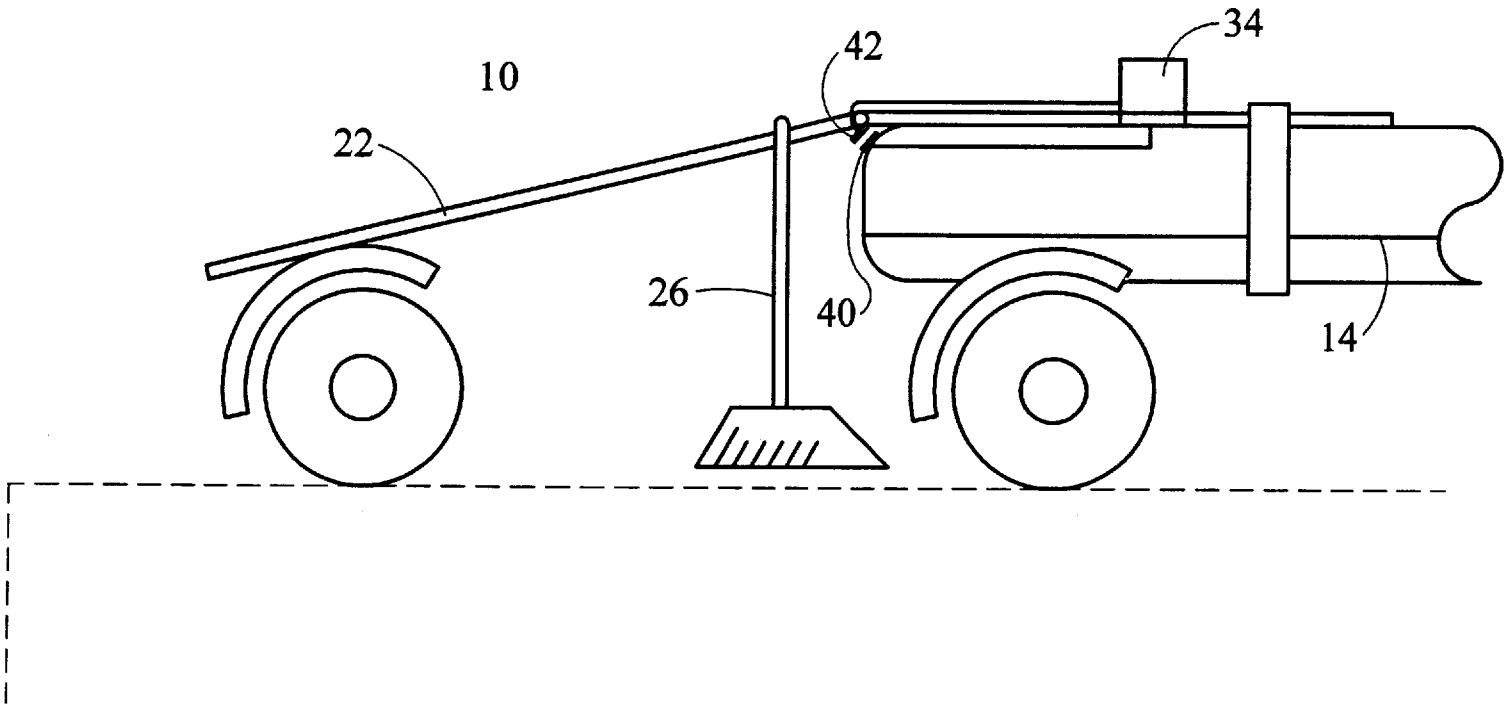
FIG. 12 is a side view of a wheel unit with a safety buzzer feature on a level surface.
Figure 13:
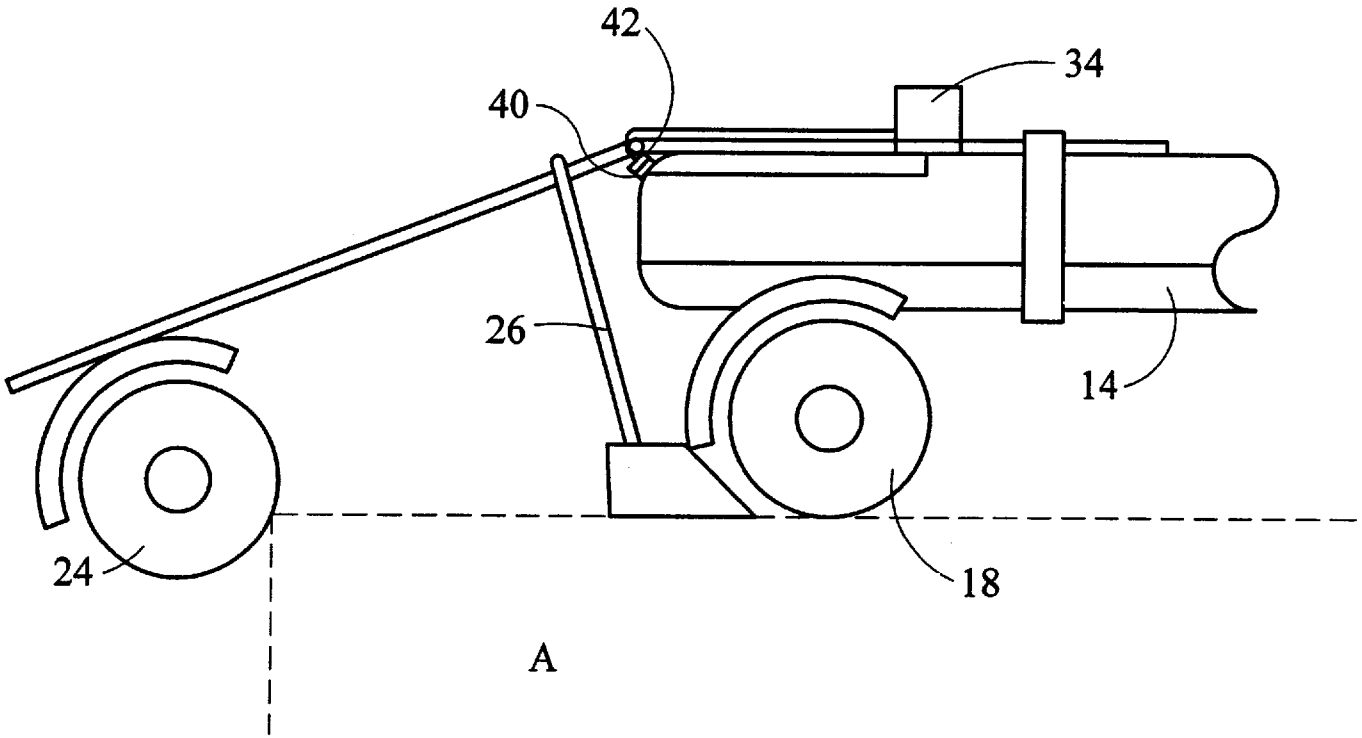
FIG. 13 is a side view of a wheel unit with a safety buzzer feature when the brake is fully engaged; and, FIG. 14 shows a side view of a complete baby walker with a baby.

FIGS. 12 and 13 illustrate a safety buzzer system to warn parents when the brake 26 has been engaged. FIG. 12 shows the a wheel unit 16 with the brake 26 not engaged. A safety buzzer 34 is mounted to the frame 14. A circuit that sets off the buzzer is comprised of the safety buzzer 34, which includes an electrical supply such as a battery, and two wires 36, 38 which lead to a first contact 40 and a second contact 42. The first contact 40 is mounted to the frame 14. The second contact 42 is mounted to the plate steel support 22. When the brake 26 is not engaged, the contacts 40, 42 do not come together, the circuit is not completed, and the safety buzzer 34 does not sound.

FIG. 13 shows a wheel unit 16 with the brake 26 fully engaged. The second contact 42 is lowered by the plate steel support 22 and comes into contact with the first contact 40 mounted to the frame 14. The contacts 40, 42 coming together closes the circuit, sounding the safety buzzer 34 and warning the parents that a child has wandered too close to a ledge or flight of stairs.

Figure 14:
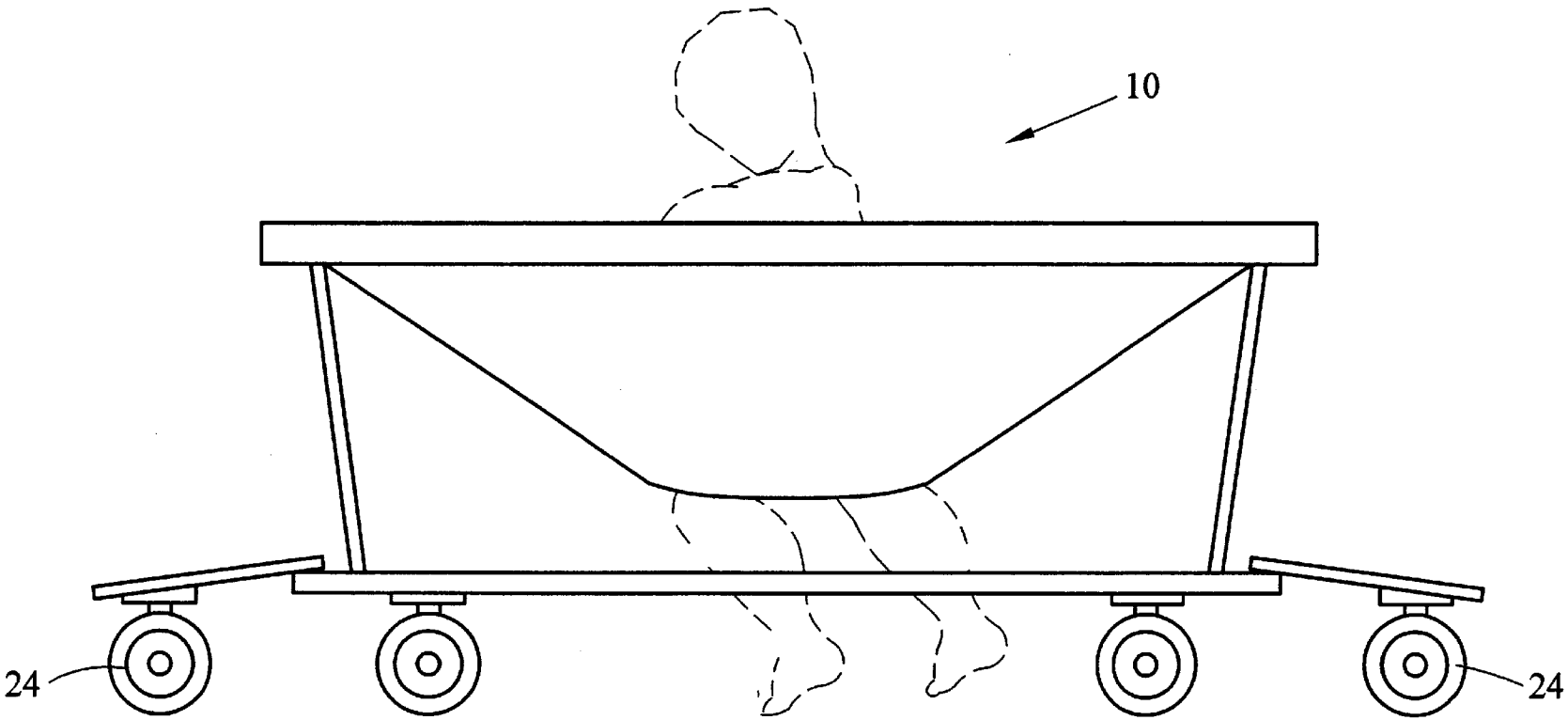

FIG. 14 shows a baby in the baby walker 10. Regardless of the direction in which the baby is walking, a safety wheel 24 will lead the rest of the baby walker 10 to prevent the baby from walking over a ledge.

The invention has been described with reference to a preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. A baby walker, said baby walker comprising:

a frame;

seating means for supporting an associated baby thereon, said seating means being supported on said frame;

translation means for enabling translating of said baby walker across flat surfaces, said translation means being rotatably fixed to said frame;

brake means for stopping the translation of the baby walker, said brake means comprising a support arm having an upper end and a lower end, said upper end being swingably attached to said frame, a wedge-shaped stopper attached to said lower end of said support arm that selectively engages and immobilizes said translation means when actuated by said actuating means, said stopper being made of a material having a high friction coefficient with the floor, said support arm being connected to said frame, and said brake means further comprising a second support arm, said second support arm being attached to said extension and said support arm, said second support arm being connected to said extension in a manner allowing said second support arm to swing in a vertical plane, and said second support arm acting in combination with said support arm to raise and lower said stopper.

2. A baby walker, said baby walker comprising an electronic safety alarm, said electronic safety alarm comprising:

seating means for a baby;

a frame, said frame providing support for said seating means;

a buzzer, said buzzer being connected to said frame;

a battery, the battery connected to said buzzer;

translation means for allowing movement of said baby walker, said translation means being fixed to said frame;

said translation means each comprising:

a main wheel, said main wheel being directly fixed to said frame;

a hinge, said hinge being attached to said frame;

a plate steel support, said plate steel support being attached to said hinge and extending outward from said frame;

a safety wheel, said safety wheel being attached to said plate steel support;

a first contact, said first contact being attached to said frame;

a first wire, said first wire connecting said first contact and said buzzer;

a second contact, said second contact being attached to said plate steel support;

a second wire, said second wire connecting said second contact and said buzzer;

said first contact and said second contact being separated when said safety wheel and said main wheel have equal elevation; and, said first contact and said second contact coming together causing said buzzer to operate when said safety wheel drops to lower vertical elevation than said main wheel.

3. A baby walker, said baby walker comprising:

a frame;

seating means for supporting an associated baby thereon, said seating means being supported on said frame;

translation means for enabling translating of said baby walker across flat surfaces, said translation means being rotatably fixed to said frame;

brake means for stopping the translation of said baby walker, said brake means comprising a support arm having an upper end and a lower end, said upper end being swingably attached to said frame, and and a stopper attached to said lower end of said support arm; and, actuating means for activating said brake means.

4. The baby walker of claim 3 wherein said actuating means comprises:

an extension having a first end and second end, said first end being swingably attached to said frame; and, a interface means for interfacing with an associated floor, said interface means being fixed to said second end of said extension.

5. The baby walker of claim 4 wherein said baby walker further comprises:

a support arm having an upper end and a lower end, said upper end being swingably attached to said frame; and, a stopper attached to said lower end of said support arm.

6. The baby walker of claim 3 wherein said baby walker further comprises an extension having a first end and a second end, said first end being swingably attached to said frame.

7. A baby walker, said baby walker comprising:

a frame;

seating means for supporting an associated baby thereon, said seating means being supported on said frame;

translation means for enabling translating of said baby walker across flat surfaces, said translation means being rotatably fixed to said frame;

brake means for stopping the translation of the baby walker, said brake means comprising a support arm having an upper end and a lower end, said upper end being swingably attached to said frame and a stopper attached to lower end of said support arm;

actuating means for activating said brake means; and, an extension having a first end and a second end, said first end being swingably attached to said frame, said upper end of said support arm being slidably received within a slot in said extension.

8. The baby walker of claim 7 wherein said upper end of said support arm further comprises a bulbous cap, said bulbous cap preventing said upper end from sliding out said slot.

9. The baby walker of claim 8 wherein said first end of said support arm is swingably attached to said extension via a hinge and swings only in a vertical plane.

10. The baby walker of claim 3 wherein said stopper is wedge-shaped.

11. The baby walker of claim 10 wherein said stopper selectively engages and immobilizes said translation means when actuated by said actuating means.

12. The baby walker of claim 11, wherein said stopper is made of a material having a high friction coefficient with the floor.

13. The baby walker of claim 3 wherein said translation means comprises main wheels rotatably fixed to said frame.

* * * * *